US010030925B1

(12) United States Patent
Bianchin et al.

(10) Patent No.: US 10,030,925 B1
(45) Date of Patent: Jul. 24, 2018

(54) INTERNAL FIREARM LOCKING MECHANISM

(71) Applicants: Robert Bianchin, Butler, PA (US); Michael Hebor, Pittsburgh, PA (US); Richard L. Wilson, Butler, PA (US)

(72) Inventors: Robert Bianchin, Butler, PA (US); Michael Hebor, Pittsburgh, PA (US); Richard L. Wilson, Butler, PA (US)

( * ) Notice: Subject to any disclaimer, the term of this patent is extended or adjusted under 35 U.S.C. 154(b) by 34 days.

(21) Appl. No.: 14/991,116

(22) Filed: Jan. 8, 2016

Related U.S. Application Data

(60) Provisional application No. 62/101,366, filed on Jan. 8, 2015.

(51) Int. Cl.
*F41A 17/00* (2006.01)
*F41A 17/44* (2006.01)
*F41A 17/02* (2006.01)

(52) U.S. Cl.
CPC ..... *F41A 17/44* (2013.01); *F41A 17/02* (2013.01)

(58) Field of Classification Search
CPC ..... F41A 17/02; F41A 17/34; F41A 17/36; F41A 17/44
USPC ..... 42/70.11
See application file for complete search history.

(56) References Cited

U.S. PATENT DOCUMENTS 2,479,107 A * 8/1949 Garretson ..... F41A 17/44 42/70.01
2,530,560 A * 11/1950 Young ..... F41A 17/44 42/70.01
2,836,918 A * 6/1958 Pula ..... F41A 17/44 138/89
2,923,323 A * 2/1960 Franck ..... F16L 55/132 138/89
2,997,802 A * 8/1961 Robbins ..... F41A 17/44 42/70.01
3,089,272 A * 5/1963 McKinlay ..... F41A 17/44 42/70.11
3,360,880 A * 1/1968 Finnegan ..... F41A 17/44 42/66
4,266,356 A * 5/1981 Jarvinen ..... F41A 17/44 42/70.11
4,528,765 A * 7/1985 Johnson ..... F41A 17/44 42/70.05
4,619,062 A * 10/1986 Johnson ..... F41A 17/42 42/49.02
4,654,992 A * 4/1987 Lavergne ..... F41A 17/02 42/70.01
4,709,496 A * 12/1987 Johnson ..... F41A 17/44 42/1.05
4,835,894 A * 6/1989 Libassi ..... F41A 17/44 42/70.11
4,896,447 A * 1/1990 Badoni ..... F41A 29/00 42/95

(Continued)

FOREIGN PATENT DOCUMENTS

DE 20 2006 010 962 U1 12/2006

*Primary Examiner* — Michelle R Clement
(74) *Attorney, Agent, or Firm* — William F. Lang, IV; Lang Patent Law LLC

(57) ABSTRACT

An internal firearm locking mechanism includes a block that fits within the action of a firearm, and a lock that is removably secured to the block and passes into the chamber of the firearm to resist insertion of a cartridge as well as removal of the block. An installation/removal tool is used to install and remove the internal firearm locking mechanism.

3 Claims, 10 Drawing Sheets

(56) References Cited

U.S. PATENT DOCUMENTS 4,999,940 A * 3/1991 Madden ..... F41A 17/44 42/70.11
5,044,106 A * 9/1991 Slocum ..... F41A 17/44 211/64
5,048,211 A * 9/1991 Hepp ..... F41A 17/44 42/70.11
5,054,223 A * 10/1991 Lee ..... F41A 17/44 42/70.11
5,097,613 A * 3/1992 Miller ..... F41A 17/44 42/1.05
5,099,596 A * 3/1992 Butler, Jr. ..... F41A 17/74 42/70.11
5,115,589 A * 5/1992 Shuker ..... F41A 17/44 42/70.11
5,138,785 A * 8/1992 Paterson ..... F41A 17/44 42/66
5,171,924 A * 12/1992 Honey ..... F41A 17/44 42/66
5,179,234 A * 1/1993 Cvetanovich ..... F41A 17/44 42/70.11
5,231,236 A * 7/1993 Del Real ..... F41A 17/44 42/70.11
5,233,777 A * 8/1993 Waterman, Jr. ..... F41A 17/44 42/70.11
5,311,691 A * 5/1994 Cacek ..... F41A 17/42 42/1.01
5,400,538 A * 3/1995 Shannon ..... F41A 17/54 42/70.06
5,410,832 A * 5/1995 Barnhart ..... F41A 17/44 42/1.05
5,419,069 A * 5/1995 Mumbleau ..... F41A 17/02 42/70.11
5,446,988 A * 9/1995 Frederick, Jr. ..... F41A 17/44 42/66
5,450,685 A * 9/1995 Peterson ..... F41A 17/44 42/70.11
5,475,994 A * 12/1995 Briley, Jr. ..... F41A 17/44 42/70.11
5,488,794 A * 2/1996 Arrequin ..... F41A 17/44 42/66
5,491,918 A * 2/1996 Elmstedt ..... F41A 17/44 42/70.11
5,664,358 A * 9/1997 Haber ..... F41A 17/44 42/44
5,669,252 A * 9/1997 Bentley ..... F41A 17/44 42/70.04
5,680,724 A * 10/1997 Peterken ..... F41A 17/44 42/70.11
5,732,498 A * 3/1998 Arreguin ..... F41A 17/44 42/70.02
5,918,403 A * 7/1999 Lurz, Jr. ..... F41A 17/44 42/66
5,934,000 A * 8/1999 Hayes, Sr. ..... F41A 17/44 15/104.2
6,041,536 A * 3/2000 Samuels ..... F41A 17/44 42/70.11
6,052,934 A * 4/2000 Carpenter ..... F41A 17/44 42/70.11
6,202,336 B1 * 3/2001 Audino ..... F41A 17/44 42/70.11
6,212,813 B1 * 4/2001 Luna ..... F41A 17/44 42/70.11
6,226,914 B1 * 5/2001 Reed ..... F41A 17/44 42/70.08
6,250,008 B1 * 6/2001 Silver ..... F41A 17/44 42/70.01
6,311,422 B1 * 11/2001 Exum ..... F41A 17/44 42/70.11
6,374,527 B1 * 4/2002 Finardi ..... F41A 17/44 42/70.11
6,393,750 B1 * 5/2002 Rossini ..... F41A 17/02 42/70.11
6,405,472 B1 * 6/2002 Dojcsak ..... F41A 17/44 42/70.01
6,408,556 B1 * 6/2002 Achee ..... F41A 17/44 42/70.11
6,415,541 B1 * 7/2002 Rassias ..... F41C 33/0227 42/70.11
6,418,654 B1 * 7/2002 Trois ..... F41A 17/44 42/66
6,442,881 B1 * 9/2002 Kellerman ..... F41A 17/44 42/70.11
6,470,615 B1 * 10/2002 Peterken ..... F41A 17/44 42/70.01
6,499,244 B1 * 12/2002 Smith ..... F41A 17/44 42/70.11
6,526,684 B1 * 3/2003 Hickerson ..... F41A 17/44 42/70.01
6,543,171 B2 * 4/2003 Kellerman ..... F41A 17/44 42/70.11
6,560,910 B1 * 5/2003 McLaren ..... F41A 17/44 42/70.11
6,584,718 B1 * 7/2003 Serrao ..... F41A 17/02 42/44
6,591,532 B1 * 7/2003 Gilbertson ..... F41A 17/42 42/70.11
6,604,313 B1 * 8/2003 Kress ..... F41A 17/44 42/70.11
6,634,130 B1 * 10/2003 Balchunas ..... F41A 17/44 42/70.11
6,662,484 B1 * 12/2003 Andree ..... E05B 21/066 42/70.11
6,701,655 B2 * 3/2004 Milo ..... F41A 17/44 42/70.11
6,789,341 B1 * 9/2004 Badura ..... F41A 17/44 128/876
6,796,071 B2 * 9/2004 Lane ..... F41A 17/44 42/70.01
6,804,906 B1 * 10/2004 Olsen ..... F41A 17/44 42/70.11
6,862,831 B1 * 3/2005 Canaday ..... F41A 17/44 42/66
6,895,707 B2 * 5/2005 Young ..... F41A 17/44 42/70.11
6,901,690 B2 * 6/2005 Hanson ..... F41A 17/44 42/70.11
6,912,807 B2 * 7/2005 Meyerle ..... F41A 17/44 42/70.11
7,121,033 B1 * 10/2006 Waller ..... F41A 17/04 42/70.11
7,140,139 B2 * 11/2006 Markbreit ..... F41A 17/44 42/70.01
7,146,761 B2 * 12/2006 Milo ..... F41A 17/44 42/70.11
7,150,122 B1 * 12/2006 Ha ..... F41A 17/44 42/66
7,543,403 B1 * 6/2009 Schaefer ..... F41A 17/02 42/70.02
7,752,796 B2 * 7/2010 Ramsey, Sr. ..... F41A 17/44 42/66
7,832,136 B2 * 11/2010 Rush ..... F41A 17/44 42/66
7,849,625 B2 * 12/2010 Ligard ..... F41A 17/44 42/70.01
8,087,551 B2 * 1/2012 Henley, II ..... F41A 13/04 206/219
D701,282 S * 3/2014 Ferguson, II ..... D22/108
8,677,668 B1 * 3/2014 Caldwell ..... F41A 17/44 42/66
D716,407 S * 10/2014 Ferguson, II ..... D22/108
8,857,092 B2 * 10/2014 Bitsack ..... F41A 17/44 42/70.11
9,810,499 B1 * 11/2017 Silver ..... F41A 17/44
2001/0034961 A1 * 11/2001 Hickerson ..... F41A 29/02 42/70.11
2002/0092223 A1 * 7/2002 Blomquist ..... F41A 17/44 42/70.11

(56) References Cited

U.S. PATENT DOCUMENTS

2002/0152662 A1* 10/2002 Lane ..... F41A 17/44 42/70.11
2002/0189148 A1* 12/2002 Hanson ..... F41A 17/44 42/70.11
2002/0194763 A1* 12/2002 Olsen ..... F41A 17/44 42/70.11
2003/0115785 A1* 6/2003 Milo ..... F41A 17/44 42/70.11
2003/0172572 A1* 9/2003 Clark ..... F41A 17/44 42/70.11
2003/0221351 A1* 12/2003 Barber ..... F41A 17/44 42/70.11
2003/0230020 A1* 12/2003 Christiansen ..... F41A 17/44 42/1.05
2004/0011100 A1* 1/2004 Ross ..... E05B 19/00 70/408
2004/0025394 A1* 2/2004 Young ..... F41A 17/44 42/70.11
2004/0035042 A1* 2/2004 Reed ..... F41A 17/44 42/70.11
2004/0074131 A1* 4/2004 Meyerle ..... F41A 17/44 42/70.11
2004/0200114 A1* 10/2004 Milo ..... F41A 17/44 42/70.11
2005/0115131 A1* 6/2005 Markbreit ..... F41A 17/44 42/70.11
2006/0101696 A1* 5/2006 Ligard ..... F41A 17/44 42/70.11
2006/0162221 A1* 7/2006 McLaren ..... F41A 17/44 42/70.11
2006/0288624 A1* 12/2006 Ha ..... F41A 17/44 42/70.11
2007/0079540 A1* 4/2007 Giebel ..... F41A 17/063 42/70.11
2008/0047187 A1* 2/2008 Ramsey ..... F41A 17/44 42/70.11
2008/0086927 A1* 4/2008 Wajdic ..... F41A 17/44 42/70.11
2011/0119980 A1* 5/2011 Rush ..... F41A 17/44 42/70.11
2011/0173860 A1* 7/2011 Arendt ..... F41A 17/44 42/70.11
2013/0340310 A1* 12/2013 Chudwin ..... F41A 17/44 42/70.11
2015/0135571 A1* 5/2015 Kohel, Sr. ..... F41A 17/44 42/70.11
2017/0241730 A1* 8/2017 Ochoa ..... F41A 17/44
2017/0356711 A1* 12/2017 Lessard ..... F41A 17/44

* cited by examiner

INTERNAL FIREARM LOCKING MECHANISM

CROSS REFERENCE TO RELATED APPLICATION

This application claims the benefit of U.S. provisional patent application Ser. No. 62/101,366, filed Jan. 8, 2015, and entitled "Internal Firearm Locking Mechanism."

TECHNICAL FIELD

The present invention relates to the field of gun locks. More specifically, an internal gun lock is provided, which physically resists placing a cartridge within the chamber of a firearm.

BACKGROUND INFORMATION

Use of firearms by untrained or intentionally derelict individuals is inherently dangerous as it can induce serious injuries and/or fatalities. Such individuals can be characterized by individuals who are not properly trained in safe firearm use, children under the age of to have proper ability to operate a firearm, individuals not authorized to use firearms, criminals who have stolen firearms, those with Alzheimer's disease, dementia, or other mental conditions that make safe firearm usage less likely, or any other unauthorized access.

To prevent such occurrences, firearm manufacturers are required to provide a lock with every new firearm delivery. The locks provided are typically external cable locks that are locked through the action of the firearm. The cable locks are effective, but easily removed with cable cutters and can cause mechanical and aesthetic damage to the firearm. Other available locks include trigger locks that prevent firearm operation by covering the trigger but these locks do not completely immobilize the action of the firearm. A third type of firearm lock is wedged into the firing chamber of the firearm. This type of lock must maintain mechanical friction with the gun chamber and is easily defeated if there is a loss of this friction and can cause damage to the gun at the points of contact with the lock.

Gun owners do not use gun locks for various reasons. Some do not utilize a lock because the cable locks are so easy to defeat they consider them useless. Some owners are concerned about marring the internal surfaces or the exterior finishes especially when considering collectable or highly valuable guns.

Accordingly, there is a need for a simple, effective means of preventing unauthorized access to firearms. There is a further need for a simple but effective internal gun lock that does not mar surfaces with which it may come into contact. Additionally, there is a need for an inexpensive means of preventing unauthorized access to firearms that is not easily defeated by unauthorized individuals.

SUMMARY

The above needs are met by an internal firearm locking mechanism. The mechanism includes a block that is dimensioned and configured to fit within the action of a firearm. The mechanism further includes an elongated locking member defining a block engaging end and a tool engaging end. One of the block and locking member defines an externally threaded portion thereon, and the other of the block and locking member defines a threaded hole thereon. The externally threaded portion and threaded hole are dimensioned and configured to engage each other to removably secure the locking member within the barrel of a firearm when the block is within the action of a firearm. The block and locking member are dimensioned and configured to resist removal of the block and locking member from the firearm when the block and locking member are secured together within the firearm.

Additionally, a tool is provided for use with the internal firearm locking mechanism. The tool has a handle end, a locking member engaging end, and an elongated portion therebetween. One of the locking member engaging end of the tool and tool engaging end of the locking member have a non-round projection, the other of the locking member engaging end of the tool and tool engaging end of the locking member define a non-round hole that is structured to receive the non-round projection so that rotation of the tool rotates the locking member, whereby the tool may be inserted through the barrel of the firearm to secure and unsecure the locking member to the block.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
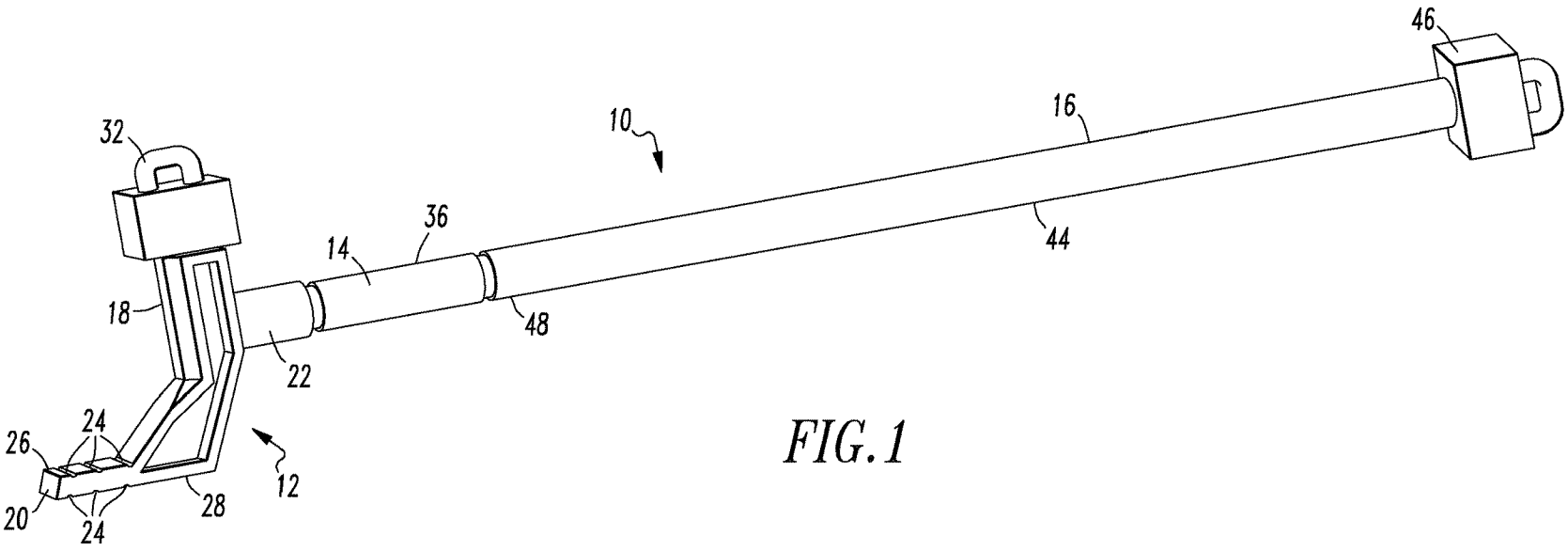
FIG. 1 is a perspective view of an assembly of an internal firearm locking mechanism along with an installation/removal tool.
Figure 2:
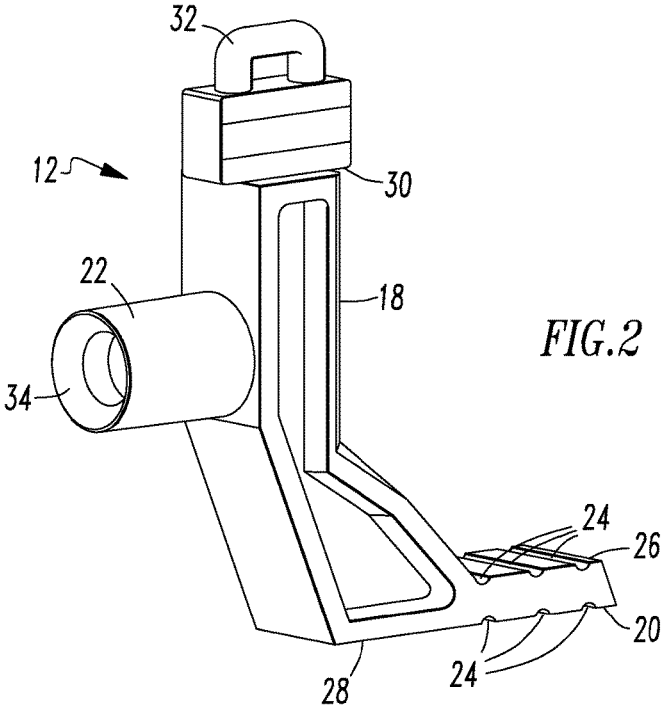
FIG. 2 is a perspective view of a block for the internal firearm locking mechanism of FIG. 1.
Figure 3:
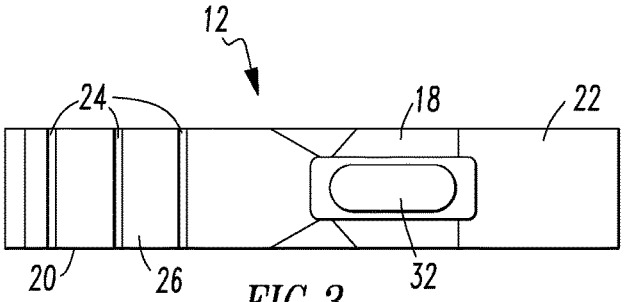
FIG. 3 is a top plan view of a block for the internal firearm locking mechanism of FIG. 1.
Figure 4:
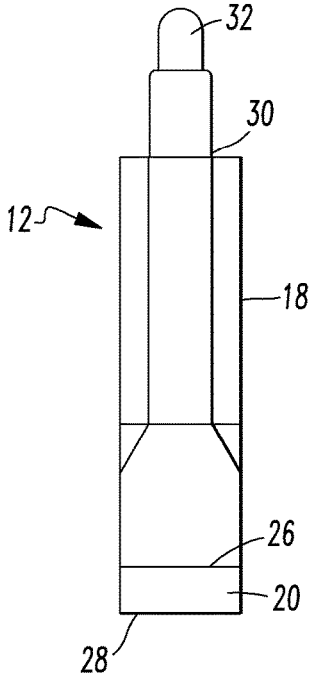
FIG. 4 is a back elevational view of a block for the internal firearm locking mechanism of FIG. 1.
Figure 5:
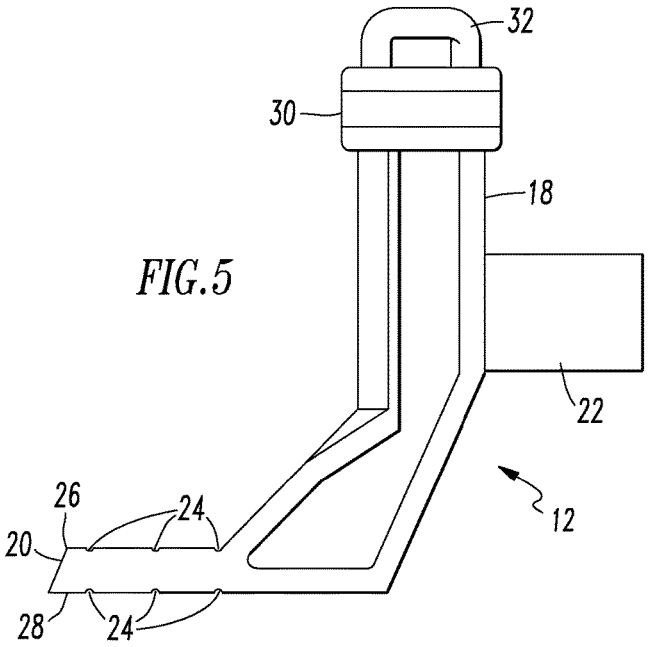
FIG. 5 is a side elevational view of a block for the internal firearm locking mechanism of FIG. 1.
Figure 6:
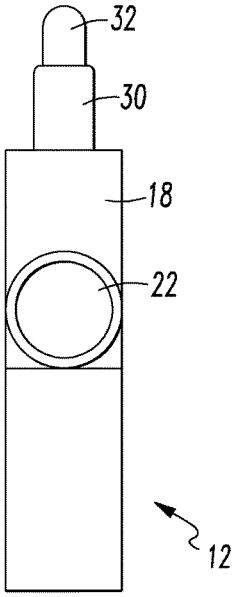
FIG. 6 is a front elevational view of a block for the internal firearm locking mechanism of FIG. 1.
Figure 7:
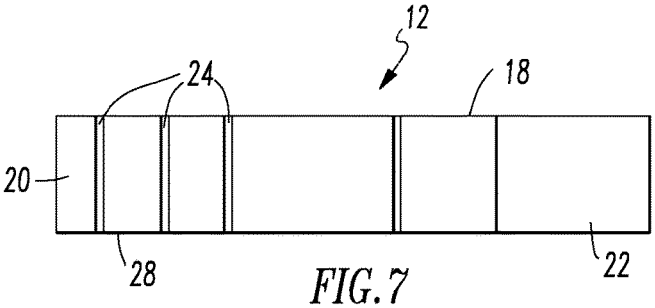
FIG. 7 is a bottom plan view of a block for the internal firearm locking mechanism of FIG. 1.
Figure 8:
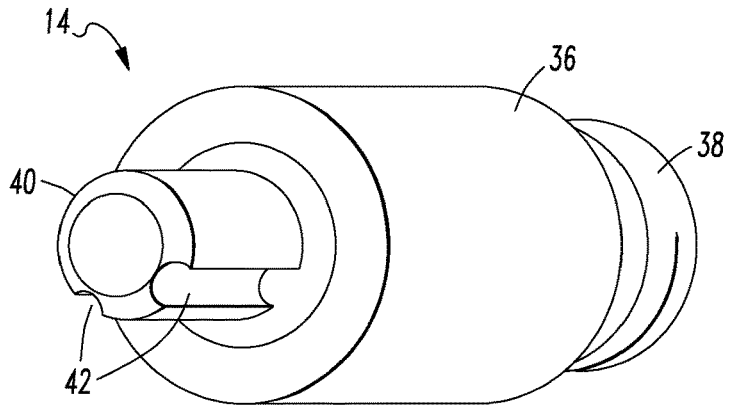
FIG. 8 is a perspective view of a locking member for the internal firearm locking mechanism of FIG. 1.
Figure 9:
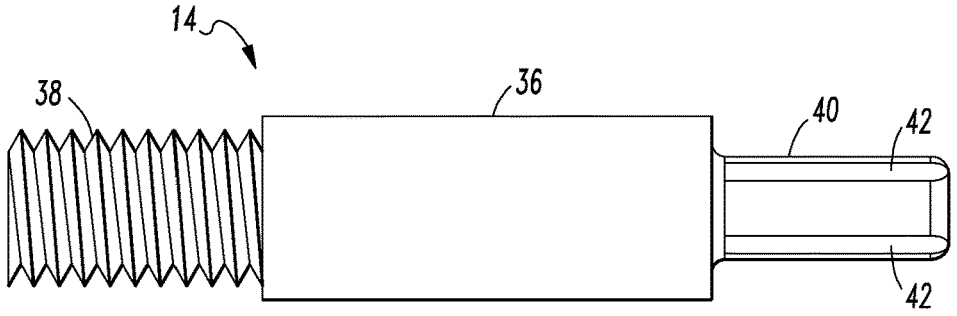
FIG. 9 is a top plan view of a locking member for the internal firearm locking mechanism of FIG. 1.
Figure 10:
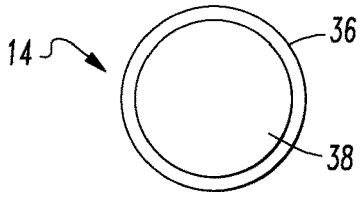
FIG. 10 is a rear elevational view of a locking member for the internal firearm locking mechanism of FIG. 1.
Figure 11:
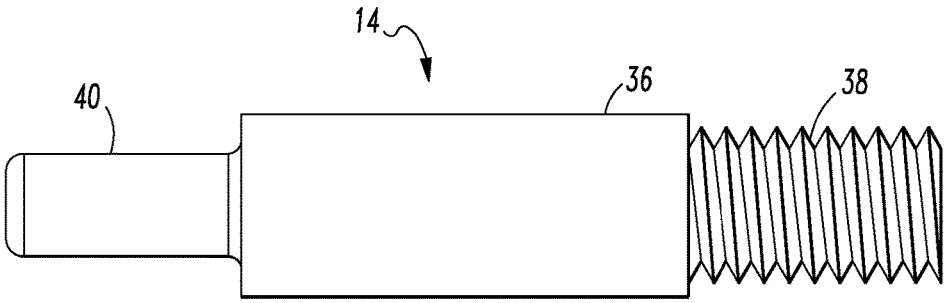
FIG. 11 is a bottom plan view of a locking member for the internal firearm locking mechanism of FIG. 1.
Figure 12:
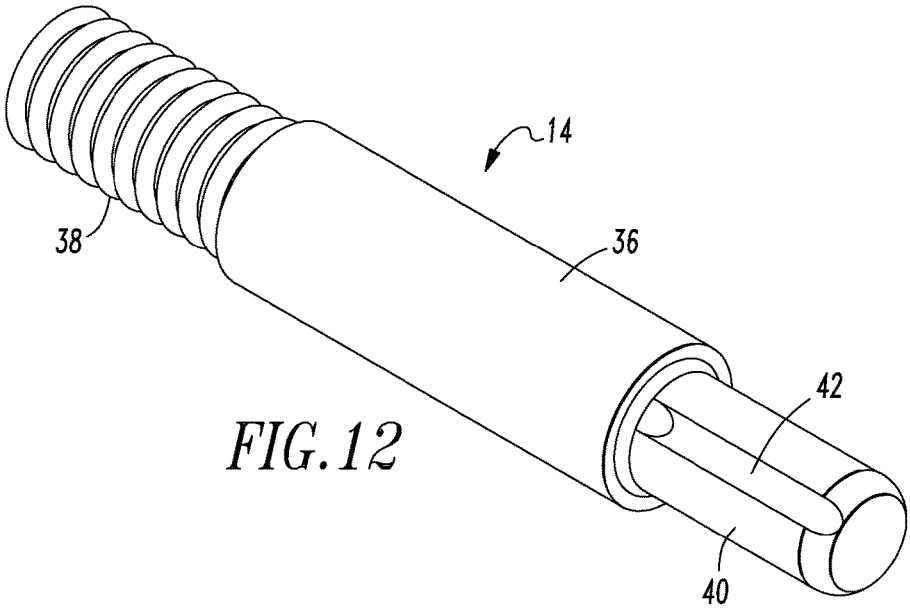
FIG. 12 is a perspective view of a locking member for the internal firearm locking mechanism of FIG. 1.
Figure 13:
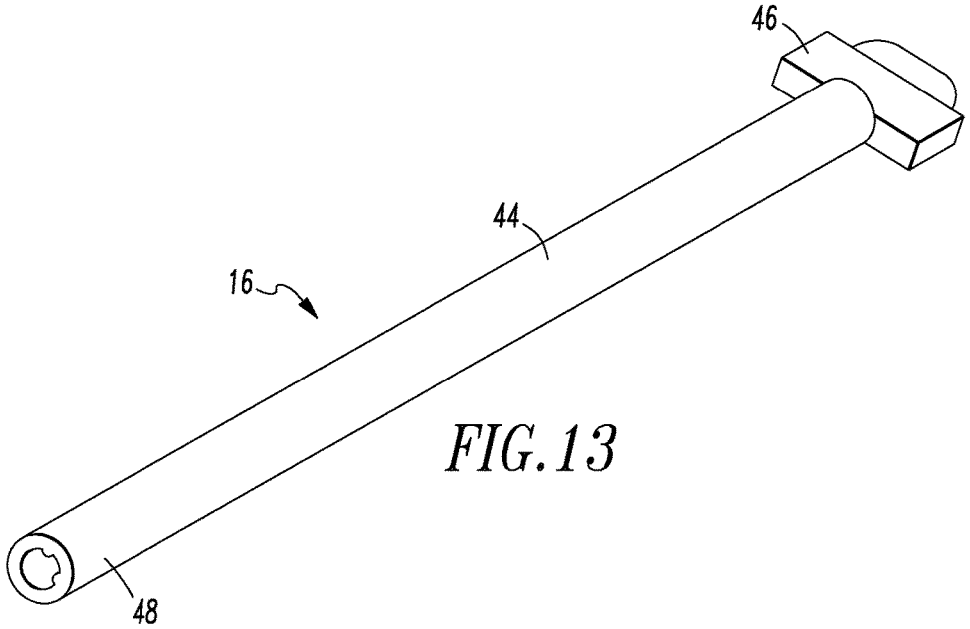
FIG. 13 is a perspective view of an installation/removal tool for the internal firearm locking mechanism of FIG. 1.

Referring to the drawings, an internal firearm locking mechanism is shown. For convenience, the internal firearm locking mechanism will interchangeably be referred to as a gun lock herein. Also for convenience, the components of the gun lock may be described in terms of relative direction such as top, bottom, front, back, or side. It should be noted that the gun lock and many of its components can be rotated in a variety of positions, without departing from the scope of the invention. Referring to FIG. 1, the internal firearm locking mechanism 10 includes a block 12 and a locking member 14. An installation/removal tool 16 is also provided.

The block 12 is shown in FIGS. 2-6. The illustrated example of the block 12 is generally L-shaped, having a generally vertical portion 18, a generally horizontal portion 20, and optionally a locking member receiving projection 22. The generally horizontal portion 20 is dimensioned and configured to correspond to the open space behind the breech within an action for receiving ammunition or a magazine, for example, the space into which a detachable magazine may be inserted in a firearm that uses such a magazine, or the space behind a tubular magazine within a firearm that utilizes such a magazine. Some examples of the generally horizontal projection 20 may include indicia to indicate a proper location to cut the generally horizontal projection 20 in order to fit various types and calibers of firearms. In the illustrated example, notches 24 are provided along the top 26 and bottom 28 surfaces of the generally horizontal member 20. Although the illustrated example includes three notches 24 along each of the surfaces 26, 28, other examples may include different numbers and/or spacing of notches 24.

The generally vertical portion 18 is structured to cooperate with the generally horizontal portion 20 to fit within an action of a firearm. Some examples of the top 30 of the generally vertical portion 18 may include a handle 32 to facilitate grasping the block 12 during installation and removal of the lock 10. In the illustrated example, the handle 32 has the appearance of a padlock. The generally vertical portion 18 also includes a locking member receiving portion, which in the illustrated example is the projection 22. The projection 22 in the illustrated example is generally cylindrical, and defines a threaded hole 34 therein.

Other alternative configurations of the block 12 may be structured to fit within the frame of a revolver when the cylinder has been swung out of the frame as would typically be performed for loading and unloading the revolver.

Referring to FIGS. 8-12, a locking member 14 is illustrated. The illustrated example of a locking member 14 is generally elongated and cylindrical, having a central portion 36, a threaded back end 38, and a tool engaging front end 40. In the illustrated example, the threaded back end 38 has a reduced diameter with respect to a central portion 36. The tool engaging front end 40 may have any non-round configuration that would permit engagement of an installation/removal tool which is described below. In the illustrated example, the tool engaging front end 40 is generally cylindrical and has a reduced diameter with respect to the central portion 36, and defines a pair of longitudinal channels 42 therein. Other tool engaging ends may have other non-round configurations, such as square, rectangular, triangular, hexagonal, etc., so that the locking member 14 can be engaged and rotated by an installation/removal tool. As another alternative, the tool engaging end 40 may have any external configuration, including cylindrical, and may define an internal hole having a non-round configuration, into which a tool may be inserted in order to rotate the locking member 14.

Figure 14:
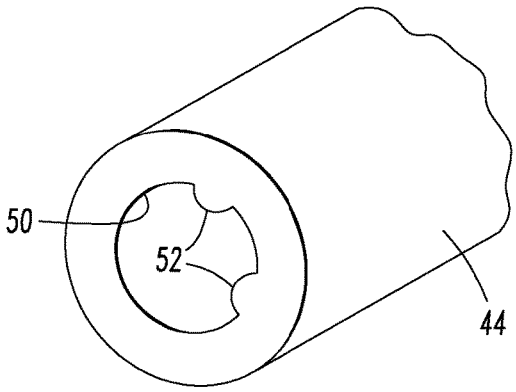
FIG. 14 is a perspective view of the locking member engaging end of an installation/removal tool for the internal firearm locking mechanism of FIG. 1.
Figure 15:
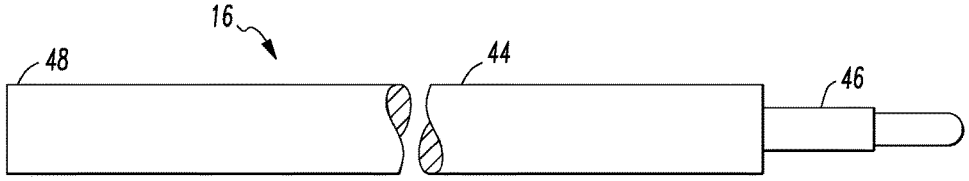
FIG. 15 is a top plan view of an installation/removal tool for the internal firearm locking mechanism of FIG. 1.
Figure 16:
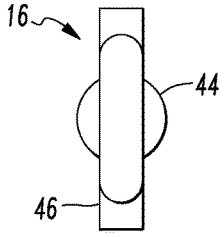
FIG. 16 is a front elevational view of an installation/removal tool for the internal firearm locking mechanism of FIG. 1.
Figure 17:
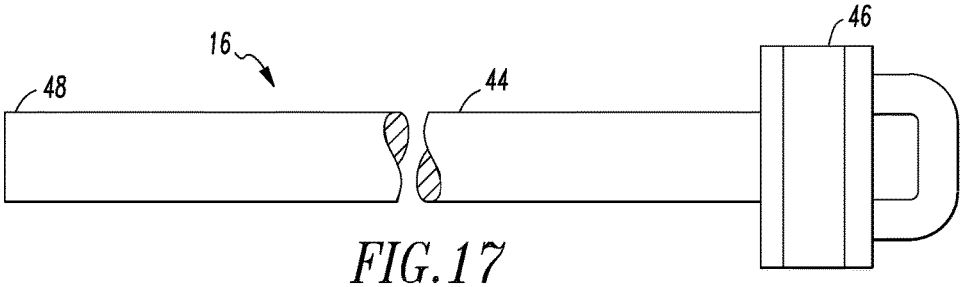
FIG. 17 is a side elevational view of an installation/removal tool for the internal firearm locking mechanism of FIG. 1.
Figure 18:
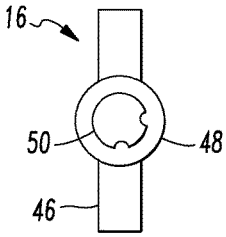
FIG. 18 is a back elevational view of an installation/removal tool for the internal firearm locking mechanism of FIG. 1.
Figure 19:
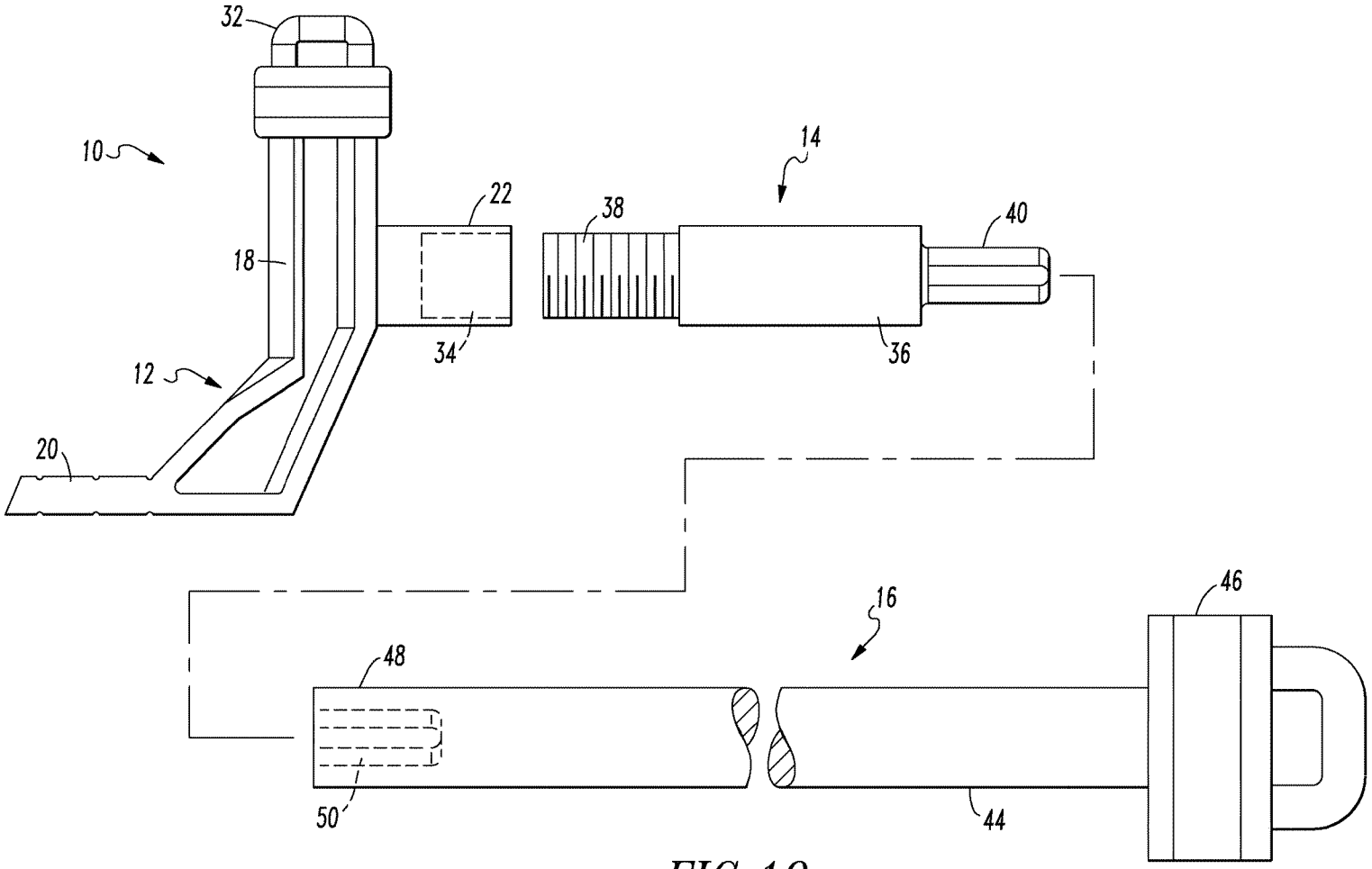
FIG. 19 is an exploded view of the assembly of the internal firearm locking mechanism and installation/removal tool of FIG. 1, showing all components separated.

Referring to FIGS. 13-18, and installation/removal tool 16 is illustrated. The installation/removal tool 16 includes an elongated shaft 44 that is structured to fit within the barrel of a firearm. The shaft 44 includes a handle 46 at one end, which in the illustrated example is configured to have the appearance of a padlock. The locking member engaging end 48 of the shaft 44 is best illustrated in FIG. 14. The illustrated example of the locking member engaging end 48 defines a hole 50 therein. A pair of longitudinal projections 52 are defined along the side of the hole 50. The longitudinal projections 52 substantially correspond in size and shape to the channels 42 defined within the locking member 14, and the diameter of the hole 50 substantially corresponds to the diameter of the tool engaging end 40 of the locking member 14.

Figure 20:
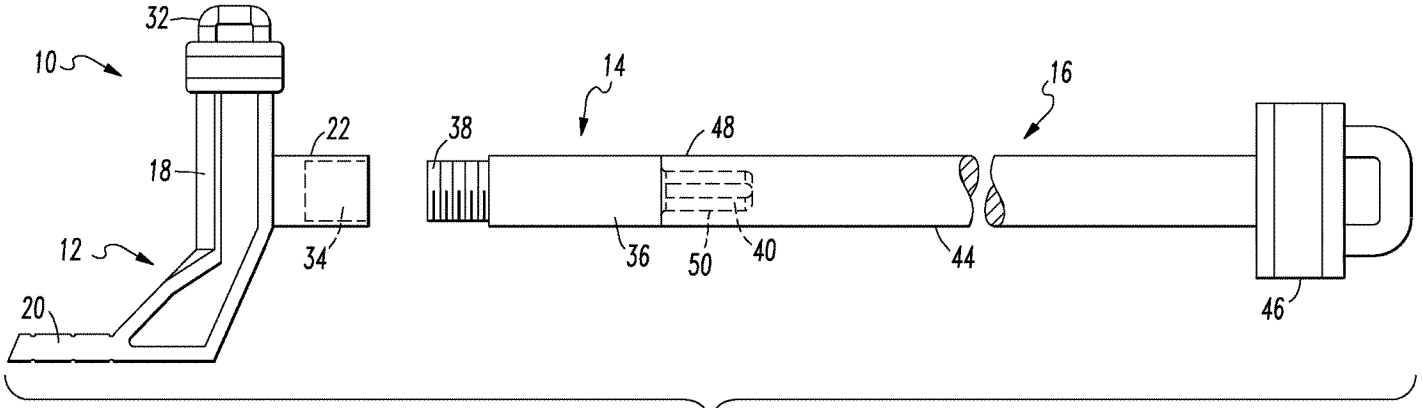
FIG. 20 is a partially exploded view of the assembly of the internal firearm locking mechanism and installation/removal tool of FIG. 1, showing the locking member engaged by the installation/removal tool.
Figure 21:
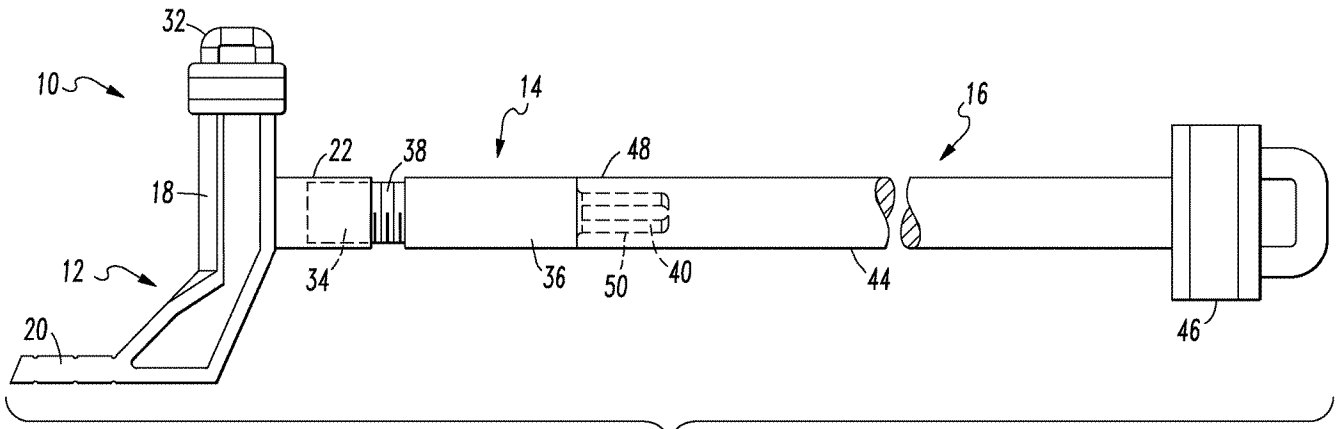
FIG. 21 is a partially exploded view of the assembly of the internal firearm locking mechanism and installation/removal tool of FIG. 1, showing the locking member being installed within the block.
Figure 22:
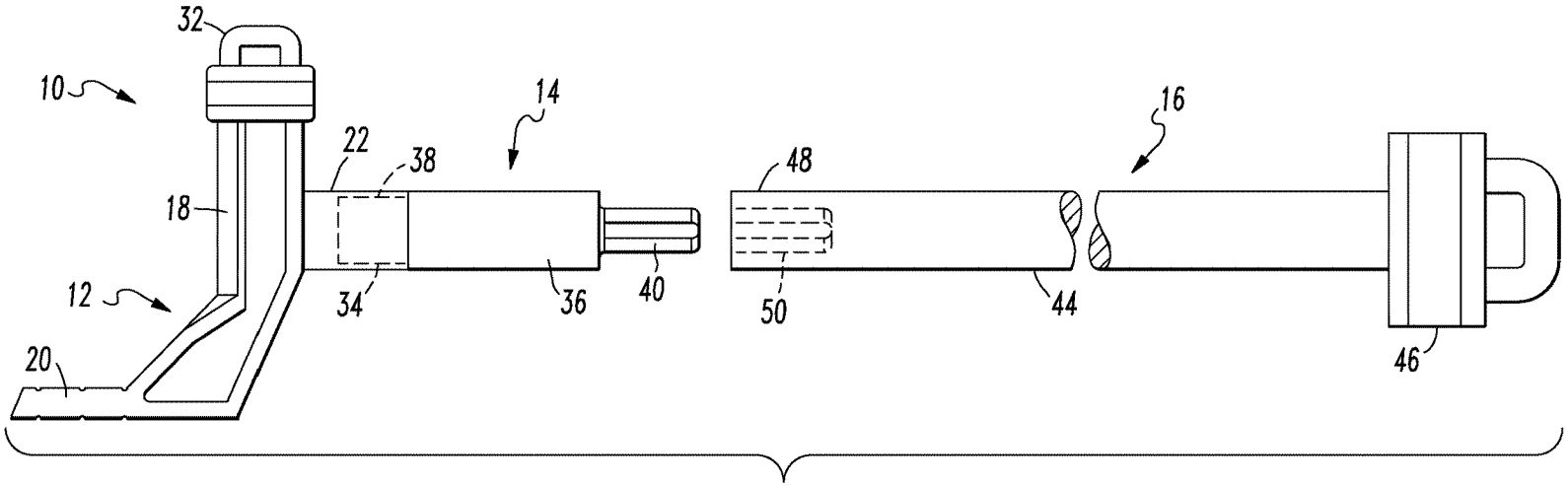
FIG. 22 is a partially exploded view of the assembly of the internal firearm locking mechanism and installation/removal tool of FIG. 1, showing the locking member installed within the block, and the installation/removal tool separated from the remainder of the assembly.

Installation and removal of the gun lock 10 is illustrated in FIGS. 19-22. Beginning with FIG. 19, the block 12 is held in place within the action of the firearm, with the projection 22 extending into the barrel of the firearm. Referring to FIG. 20, the locking member 14 is placed on the locking member engaging end 48 of the installation/removal tool 16. As shown in FIG. 21, the threaded end 38 of the locking member 14 is threadedly secured within the threaded hole 34 defined within the projection 22 of the block 12. Throughout this operation, the handle 32 will protrude upward from the open action of the firearm, permitting the user to hold the block 12 in the proper position during installation of the locking member 14. Referring to FIG. 22, once the locking member 14 is fully seated within the block 12, the installation/removal tool 16 may be disengaged and removed from the barrel of the firearm. At this point, with the locking member 14 secured to the block 12, the size and shape of the overall lock 10 resist removal of the lock 10 from the firearm. With the locking member 14 within the barrel, the introduction of ammunition into the barrel is resisted.

Removal of the lock 10 from the firearm has been found to be impracticable without the use of the removal tool 16. The firearm is thus secured from unauthorized use. Removal of the lock 10 from the firearm is accomplished by inserting the removal tool 16 into the barrel, engaging the locking member 14, unscrewing locking member 14 from the block 12, and then removing the locking member 14 from the barrel. The block 12 can then be removed from the action of the firearm.

The block 12, locking member 14, and installation/removal tool 16 can be made from any materials having sufficient strength to resist removal from a firearm by breaking the components, but which do not have sufficient hardness to scratch or otherwise damage the surfaces of the firearm to which they may come in contact. In particular, it is undesirable to mar the interior surface of the barrel, which is critical for the accuracy of the firearm. It is also desirable within some examples of the lock 10 to be able to cut the horizontal portion 20 of the block 12 to a desired length without excessive difficulty. Making a locking mechanism from a material that can easily be cut is generally counter-intuitive in the field of locks, for which resisting attempts to defeat the lock by cutting a lock component is generally desirable. However, the present inventors have found that the location of the lock 10 within a firearm action during use to secure a firearm permits such materials to be utilized with a high level of resistance to unauthorized removal of the lock 10 from the firearm. Numerous polymers meet these requirements. If polymer is used to form the block 12 and/or locking member 14, a steel rod may be disposed within the polymer. In the case of the locking member, the rod may be placed along its longitudinal axis. In the case of the block 12, the rod may be placed within the vertical portion 18, and perhaps also connected to the locking member receiving projection 22 or to other structures that may be provided to receive the locking member 14. Additionally, various aluminum alloys, brass, or other metals having a sufficiently low maximum hardness may be utilized.

The present invention therefore provides a simple, inexpensive, and highly effective means of securing a firearm against unauthorized access and use.

A variety of modifications to the above-described embodiments will be apparent to those skilled in the art from this disclosure. For example, the male and female threaded components for securing the locking member to the block can be reversed, so that the locking member defines a threaded hole and the block defines an externally threaded projection. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An internal firearm locking mechanism for a firearm, the firearm having a barrel defining a breech end, and a space behind the breech end for receiving ammunition or a magazine, the internal firearm locking mechanism comprising:

a block, the block being dimensioned and configured to fit within the space behind the breech end for receiving ammunition or a magazine of a firearm, the block including a generally vertical portion and a generally horizontal portion disposed within a lower portion of the generally vertical portion, the generally horizontal portion of the block being made from polymer, the generally horizontal portion of the block including indicia showing locations in which the generally horizontal portion can be cut to a predetermined size;

an elongated locking member defining a block engaging end and a tool engaging end;

one of the block and locking member defining an externally threaded portion thereon, and the other of the block and locking member defining a threaded hole thereon, the externally threaded portion and threaded hole being dimensioned and configured to engage each other to removably secure the locking member within the barrel of a firearm when the block is within the space behind the breech end for receiving ammunition or a magazine of a firearm, the block and locking member being dimensioned and configured to resist removal of the block and locking member from the firearm when the block and locking member are secured together within the firearm; and a tool having a handle end, a locking member engaging end, and an elongated portion therebetween, one of the locking member engaging end of the tool and tool engaging end of the locking member having a non-round projection, the other of the locking member engaging end of the tool and tool engaging end of the locking member defining a non-round hole that is structured to receive the non-round projection so that rotation of the tool rotates the locking member, whereby the tool may be inserted through the barrel of the firearm to secure and unsecure the locking member to the block.

2. The internal firearm locking mechanism according to claim 1, wherein the block includes a handle that is structured to protrude outward from the space behind the breech end for receiving ammunition or a magazine of the firearm when the block is within the space behind the breech end for receiving ammunition or a magazine of the firearm.

3. The internal firearm locking mechanism according to claim 1, wherein the block includes a handle disposed at a top of the generally vertical portion, the handle being structured to protrude outward from the space behind the breech end for receiving ammunition or a magazine of the firearm when the block is within the space behind the breech end for receiving ammunition or a magazine of the firearm.

* * * * *